US005170531A

United States Patent [19]

Ryan

[11] Patent Number: 5,170,531

[45] Date of Patent: Dec. 15, 1992

[54] CARRIER FOR A BATON TRAVERSING DRAPERY SYSTEM

[75] Inventor: Richard B. Ryan, Libertyville, Ill.

[73] Assignee: Hang-Well Corporation, Mundelein, Ill.

[21] Appl. No.: 491,493

[22] Filed: Mar. 12, 1990

[51] Int. Cl.[5] ..... A47H 5/02

[52] U.S. Cl. ..... 16/87.4 R; 16/87.2; 160/341

[58] Field of Search ..... 16/87.2, 87.4 R, 87.6 R; 160/340, 341

[56] References Cited

U.S. PATENT DOCUMENTS 3,743,002 7/1973 Ford ..... 160/341

3,983,921 10/1976 Ford ..... 160/341

*Primary Examiner*—Robert L. Spruill

*Assistant Examiner*—Carmine Cuda

*Attorney, Agent, or Firm*—Marshall, O'Toole, Gerstein, Murray & Bicknell

[57] ABSTRACT

Master carrier for a baton traversing drapery system comprises an elongated hanger adapted to be received in the horizontal gap of the conventional C-shaped type of traverse rod. The hanger element supports beneath the rod a platform having a rim along its outer edge which is inclined relative to the direction of travel. Spaced along the length of the inclined edge of the platform are a plurality of openings into which a drapery hook assembly can be installed and locked, by means of a clamp interacting with the rim of the platform. A pair of identical master carriers can be used to create an overlap in adjacent drapery panels without the necessity for using a projecting arm for this purpose. Attached to the outer face of the upper edge of the drapery is a baton which is attached to the drapery at substantially the point at which the drapery is suspended from the master carrier. Accordingly, when force is applied to the baton to move the drapery, little or no torque is created.

5 Claims, 4 Drawing Sheets

CARRIER FOR A BATON TRAVERSING DRAPERY SYSTEM

The present invention relates to a master carrier for use in drapery support systems of the type in which the drapery is moved along the length of a traverse rod by means of a baton attached to the drapery material, typically at a point in the vicinity of the master carrier.

BACKGROUND OF THE INVENTION

Draw draperies employ closing systems of two general types. A first type uses a continuous drawstring which passes through a hollow traverse rod to a master carrier supported by the traverse rod, to which the leading edge of the drapery is attached. By pulling on the drawstring in the proper direction, the master carrier can be made to move the edge of the drapery to an open or closed position as desired. When two drapery panels are used to span a given surface, such as a window, from opposite sides, it is conventional to provide on the inboard edge of one master carrier an extension which causes the edges of the draperies to overlap, thus eliminating any gap between the closed draperies.

The drapery-operating system described above is relatively complex in design and delicate in construction. Because of these weak points, it is conventional for draperies installed in commercial establishments, such as hotel and motel rooms, to use a second type of closing system which is simpler and more rugged than that using draw cords. In this type of system, the drapery is opened and closed using a baton attached to the upper part of the inboard edge of the drapery, by means of which the drapery is pushed or pulled into the desired position. These systems usually include an arm extending inwardly from the master carrier of one drapery in order to achieve an overlap with the opposite drapery as previously described. It is also conventional to attach the operating baton to the elongated arm supporting the leading edge of the drapery.

Although the commercial systems eliminate some operating problems caused by the string-actuated draw system, they are subject to other deficiencies. The elongated arm supporting the leading edge of the drapery, to which a baton is fixed, is itself fragile and easily deformed by excessive force. The application of such force is likely, moreover, because the point of attachment of the baton is not located near the point of support of the drapery on the master carrier, but rather forward of this position. Accordingly, unless care is taken in the operation of the draperies, it is easy to apply a torque to the master carrier, causing it to become deformed or to bind and thus to break or wear excessively.

BRIEF DESCRIPTION OF THE PRESENT INVENTION

The present invention provides an improved master carrier for use in a baton-traversing drapery system which does not have an arm extending in the direction of travel.

The elimination of the extended arm avoids the susceptibility to damage which is inherent in such constructions. The carrier of the present invention has a contour which in itself is used to provide an overlap to adjacent draperies. The carrier of the invention is not symmetrical at its ends, one end flaring outwardly while the other flares inwardly. Accordingly, when two such carriers are in adjacent position, the edge of one drapery, following the contour of its associated master carrier, can be made to flare inwardly, while the adjacent drapery flares outwardly and covers the gap between the two. This effect is achieved without employing any extensions for creating the desired outward or inward flare of the drapery edges.

The carrier of the invention comprises an elongated hanger adapted to be received in the horizontal gap of the conventional C-shaped type of traverse rod. The hanger element supports beneath the rod a platform having a rim along its outer edge which is inclined relative to the direction of travel, i.e., the outer edge of the platform is at one of its ends closer to the traverse rod than at the other. Spaced along the length of the inclined edge of the platform are a plurality of openings into which a drapery hook assembly can be installed and locked, by means of a clamp interacting with the rim of the platform. The hook assembly also includes means for attaching the upper edge of a drapery thereto, and in a preferred embodiment also permits adjusting the length of the drapery. Attached to the outer face of the upper edge of the drapery is a baton which is attached to the drapery at substantially the point at which the drapery is suspended from the master carrier. Accordingly, when force is applied to the baton to move the drapery, little or no torque is created.

DESCRIPTION OF THE DRAWINGS

The invention will be better understood from the description which follows, taken in conjunction with the accompanying drawings, in which.

DETAILED DESCRIPTION OF THE PREFERRED EMBODIMENTS

Figure 1:
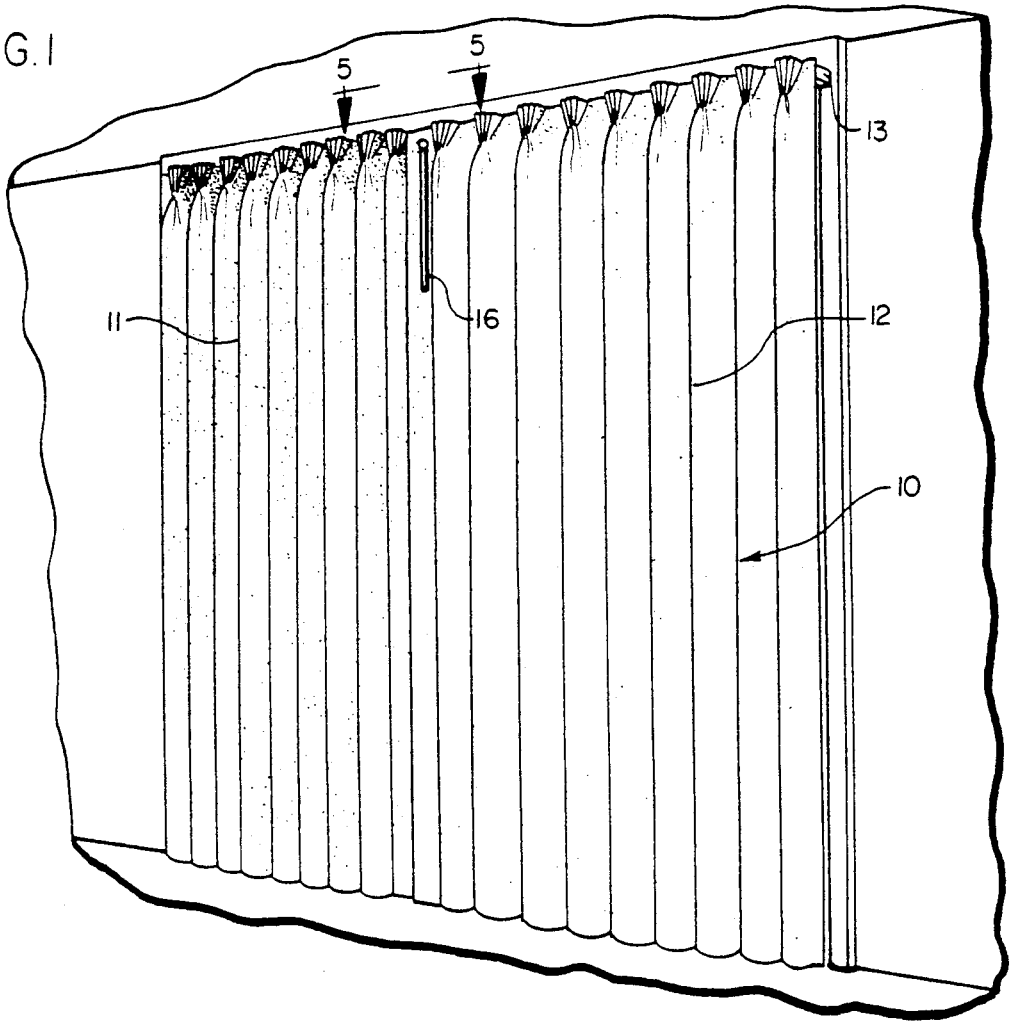
FIG. 1 is a perspective view of a pair of draperies employing the carrier system of the invention, in closed position.
Figure 2:
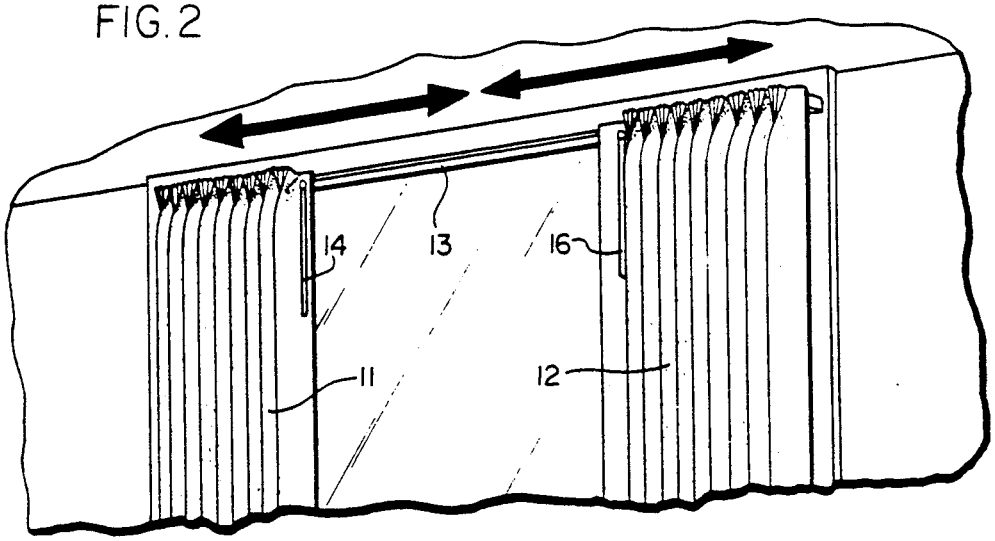
FIG. 2 is a view similar to that of FIG. 1 showing the draperies in open position.

FIGS. 1 and 2 show draperies of the baton-traverse type with which the carrier of the invention is suitably used. As shown in the figures, the drapery 10 consists of two panels, a left half 11 and a right half 12 which are suspended at their top edges from a traverse rod 13. Each of the drapery panels has connected to its upper inboard edge a baton 14 or 16 which is used to position the drapery as desired, including the position shown in FIG. 1 in which the inboard edge of the right drapery overlaps that of the left drapery to seal completely the window on which the drapery is installed.

Figure 3:
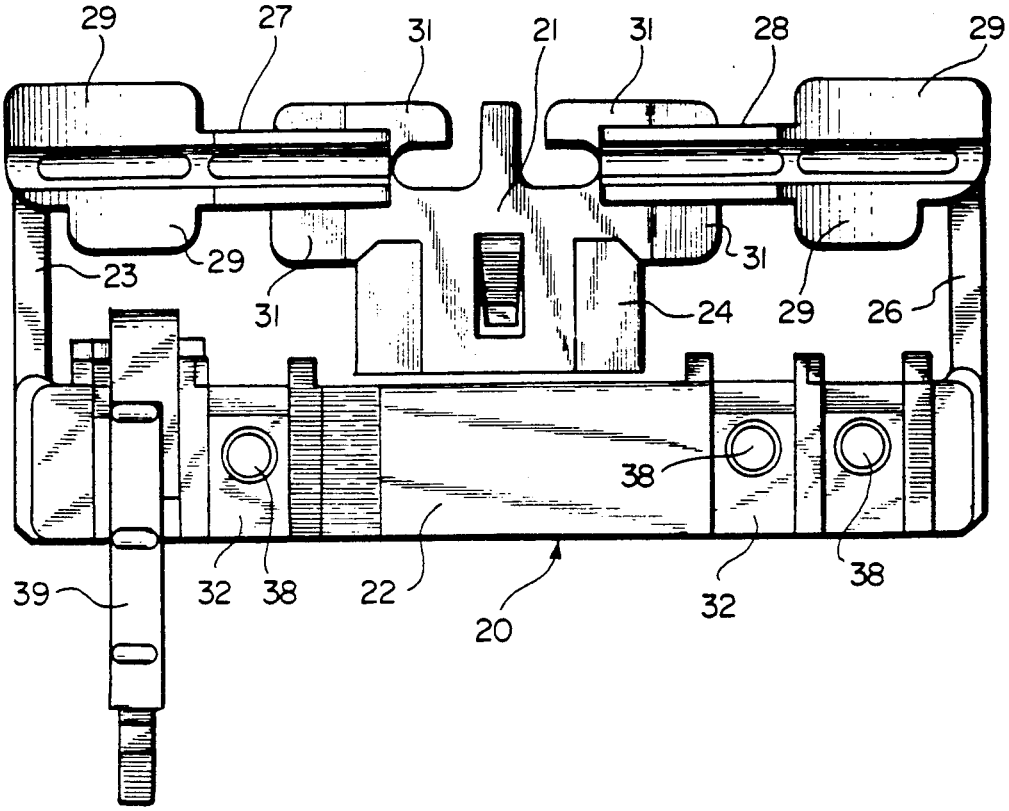
FIG. 3 is a front (elevational) view of the master carrier of the invention with a drapery hook installed at the left end thereof.
Figure 4:
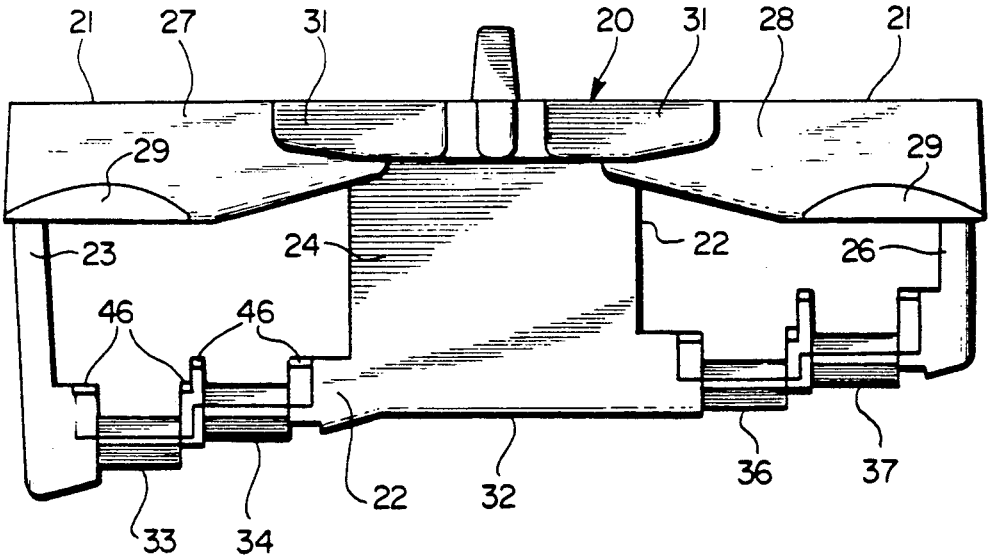
FIG. 4 is a top view of the carrier of FIG. 3 showing the inclined outer rim of the carrier.
Figure 8:
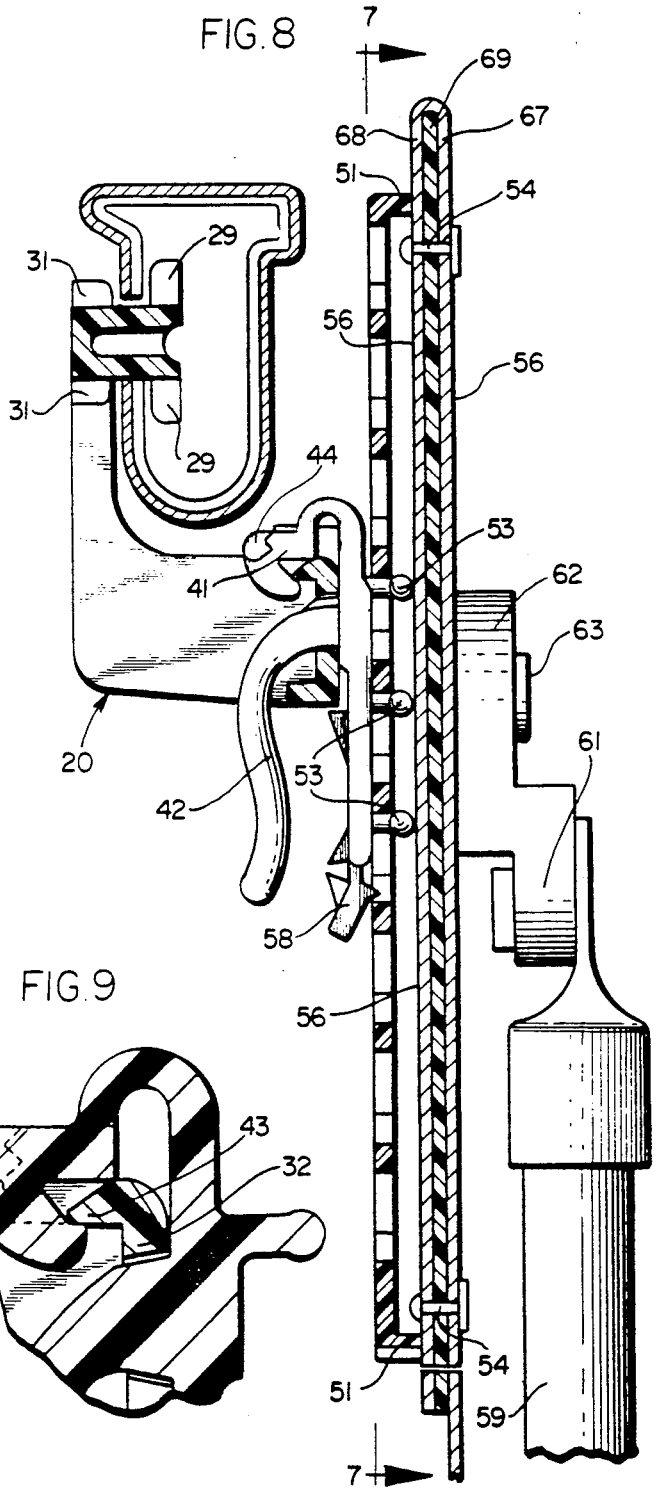
FIG. 8 is a cross sectional view along the line 8—8 of FIG. 5 showing a hook assembly engaged with a plate assembly as in FIG. 7, with a baton attached to the outer surface of the drapery.

Shown in FIGS. 3, 4, and 8 are front, top, and side views of the carrier 20 of the invention. As shown, carrier 20 includes a hanger portion 21 from which a skeletal platform 22 is suspended by members 23, 24, and 26.

Hanger portion 21 contains a pair of symmetrical horizontal plate members 27 and 28, which are provided on their upper and lower surfaces with spaced positioning elements 29 and 31, which are so situated as to define an elongated channel on the top and bottom surfaces of elements 27 and 28 within which the edges of a slot in a C-shaped traverse rod 13 can pass, as shown in FIG. 8. The positioning elements 29 and 31 are rounded to minimize friction and are so placed to permit carrier 20 to slide easily along the length of traverse rod 13 but to prevent disengagement of the carrier from the rod in normal operation.

Skeletal platform 22 attached to hanger portion 21 has an edge or rim portion 32 which is inclined with respect to the passageway formed by positioning elements 29 and 31, i.e., inclined with respect to the direction of travel of carrier 20.

Rim 32 proceeds in a series of four steps in FIG. 4, from a position at the left of the FIGURE which is at a maximum distance from hanger portion 21 to a position at the right of the figure which is at a minimum distance from the hanger portion. Each of the stepped portions 33, 34, 36, and 37, has in its vertical wall an opening 38 for receiving the hook of an assembly such as that shown in FIG. 6. FIG. 3 shows such a hook assembly 39 installed in the left-most step 33 of the platform (see also FIG. 8). By installing hook assembly 39 in any one of steps 33, 34, 36, or 37 within rim 32 of platform 22, the hook assembly can be positioned at a variable lateral distance as desired from a traverse rod on which the carrier is installed.

Figure 6:
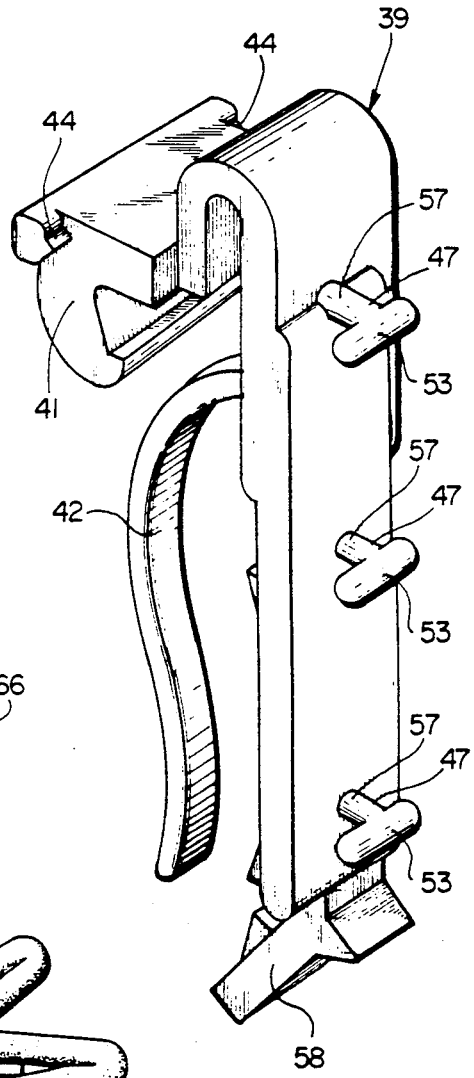
FIG. 6 is an enlarged isometric view of a hook assembly which can be used with the carrier of the invention, as shown in FIG. 3.
Figure 9:
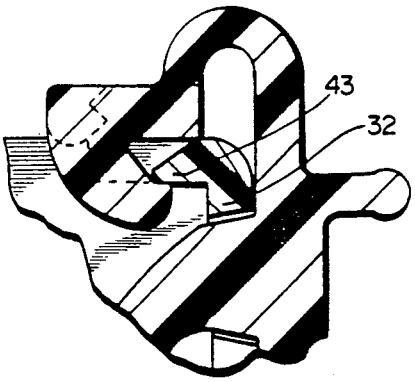
FIG. 9 is a detail of the locking means used to attach the hook of FIG. 6 to the master carrier.

Hook assembly 39, shown in enlarged detail in FIG. 6, is provided with a clamp 41 which will engage any one of steps 33, 34, 36, or 37 in platform 22 and from which it will not unintentionally disengage. Hook assembly 39, including clamp 41, is suitably made of a resilient material, e.g., delrin or nylon, having strength properties appropriate for its use. After the hook 42 of the assembly 39 has been passed through a desired opening in rim 32, clamp means 41 at the upper end of assembly 39 snapped into engagement with a projecting lug 43 at the upper edge of rim 32 (see FIG. 9). At the same time, a boss 44 formed on both ends of the clamp engages a similar projection 46 positioned on both sides of each step (see FIG. 4). Thus, when hook assembly 39 is clamped into place, it maintains its position until it is intentionally disengaged.

Figure 7:
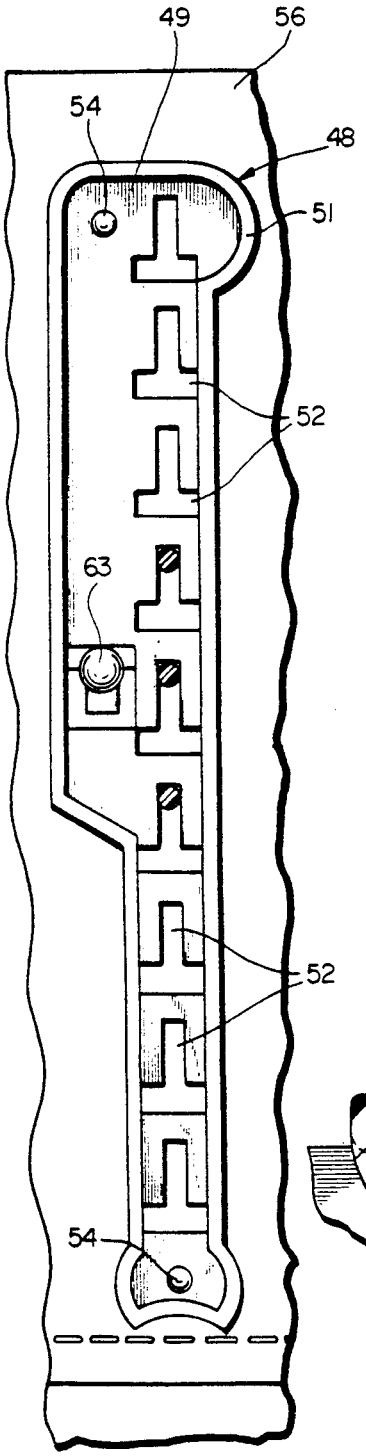
FIG. 7 is an enlarged view of a plate assembly on the inner face of a drapery which interacts with the hook assembly of FIG. 6 to secure the drapery to the master carrier.

It will be seen that the outer surface of hook assembly 39 shown in FIG. 6 is provided with three outwardly projecting T-shaped barbs 47. These barbs cooperate with an elongated end hook carrier 48 (FIG. 7) comprising a elongated vertical plate 49 having a downturned rim 51 and a series of inverted T-shaped slots 52. The T-shaped slots are positioned and adapted to engage the projecting T-shaped barbs 47 on hook assembly 39. Clearance for the transverse sections 53 below the bottom of plate 49 is provided by rim 51 with which plate 49 is equipped.

End hook carrier 48 is attached by suitable means, e.g., plastic rivets 54, to the inner face 56 of a drapery 56 at a point close to the top and adjacent an edge thereof. After the end plate is properly installed, a hook assembly 39 is attached to the carrier 48 by passing the transverse sections 53 of barbs 47 on the hook assembly into the horizontal sections of the T-shaped slots 52 in the end hook carrier, after which the hook assembly is moved upwardly to cause the vertical legs of T-shaped slots 52 to accept the connecting portions 57 of barbs 47.

The lower end of hook assembly 39 is provided with a resilient tab 58 which snaps into a horizontal slot of one of the T-shaped slots and locks the hook assembly against being displaced by downward movement. The hook assembly can be repositioned when desired by lifting resilient tab 58 thus permitting the hook assembly to be moved downwardly until transverse sections 53 of each barb 47 can be lifted free of T-shaped slots 52 in plate 49. In this way, the free length of the drapery hanging below the hook assembly can be adjusted over a range corresponding to the vertical dimension of end hook carrier 48.

Shown in FIG. 8 is the upper end of a baton 59 which is rotatably connected via a rotatable joint 61 to a fitting 62 which is itself rotatably fastened to end hook carrier 48 by appropriate means, such as a plastic fastener 63, which passes through drapery 56 and engages a suitable opening in end hook carrier 48. The point of attachment of fastener 63 to end hook carrier 48 is made as close as possible to the vertical series of T-shaped slots 52. Accordingly, any force exerted by baton 57 through fastener 63 is practically collinear with that exerted by the force of gravity on hook 42, so that the amount of torque created by the application of a force on the baton, relative to the point of attachment of the drapery to the carrier, is very small.

Figure 5:
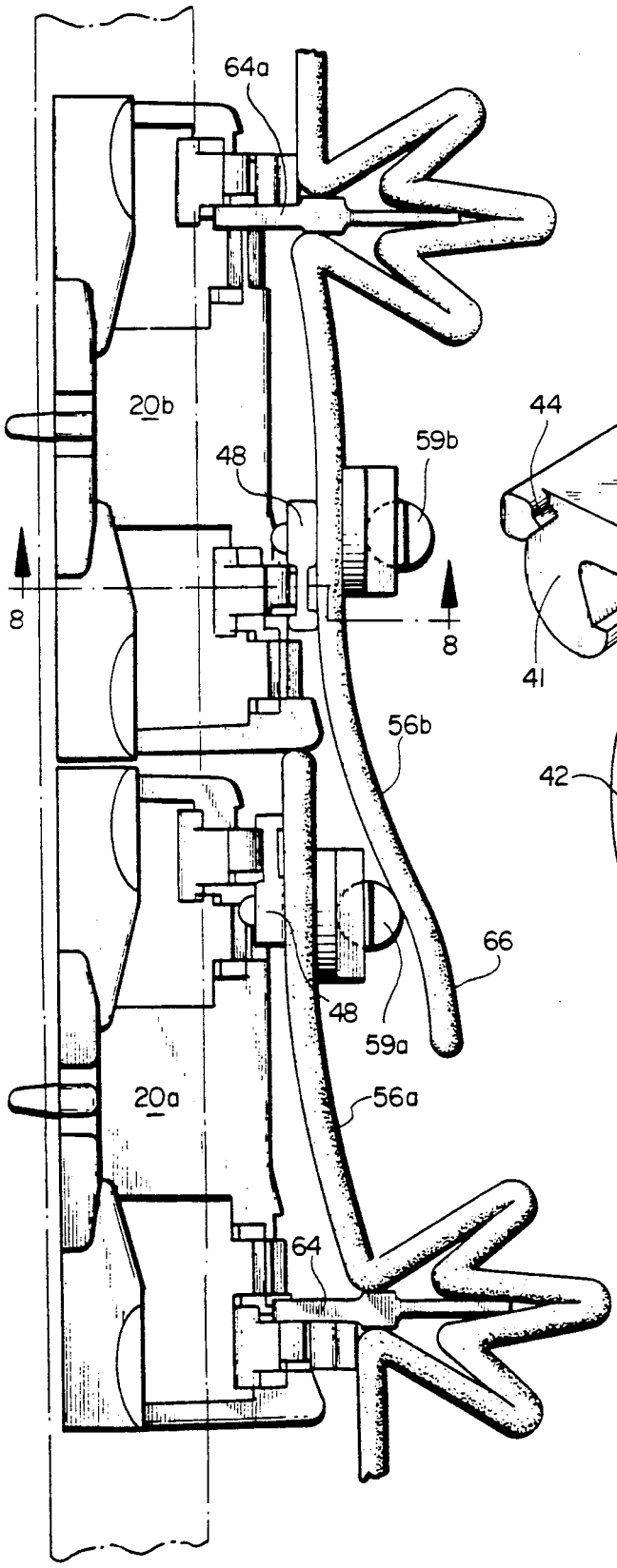
FIG. 5 is a cross sectional view along the line 5—5 in FIG. 1, showing the overlap of the edges of the draperies which is achieved by the carrier of the invention.

Shown in FIG. 5 is an assembly which provides for overlapping of the inboard edges of a pair of draperies such as those shown in FIGS. 1 and 2. The assembly consists of two carriers 20 identical in construction and inserted in the same C-shaped traverse rod (not shown). In the left carrier 20*a*, the right end is provided with an end hook carrier 48 such as that shown in FIG. 7 and previously described. The end hook carrier is inserted in the step closest to the right edge of carrier 28*a*, close to the edge of the drapery 56 and is provided with a baton 59*a* installed as previously described (FIG. 8). At the left end of carrier 20*a*, there is installed a drapery hook 64 of an appropriate type which forms no part of the present invention, suitable for forming a pleat or for supporting a preformed pleat in drapery 56*a*. Appropriate hooks for this purpose are shown in my previous U.S. Pat. No(s). 4,344,210 and 4,407,051. It will be seen that because the outer edge of carrier 20*a* tapers inwardly towards the traverse rod, hook 64 at the left end is farther away from the traverse rod than is the other end of the drapery attached to the step at the right end of carrier 20*a*. Accordingly, the edge of drapery 56*a* attached to the left hook flares inwardly.

In FIG. 5, carrier 20*b*, located adjacent carrier 20*a*, is of identical construction and has an end hook carrier 48 positioned at step 34 close to the left end of the carrier.

At the right side of carrier 20*b*, there is located a drapery hook 64*a* similar to hook 64 which is installed on carrier 20*a*. As in the case of hook 64, the construction of hook 64*a* does not form a part of the present invention. Any hook which will support a drapery in desired fashion, or which will form a pleat in a drapery, can be used as desired. As in the case of carrier 20*a*, the tapering rim or outer edge of carrier 20*b* tends to create an outward flare in the edge 66 of drapery 56*b* to which carrier 20*b* is attached. The outward flare created in this manner provides clearance for the leading edge of the drapery attached to carrier 20*a*, causing the adjacent edges of the draperies to overlap when the carriers abut as shown in FIG. 5. In order to assist in achieving the outward flare of edge 66, it may be desirable to incorporate in the edge of the drapery at this point an interior sheet or layer of a relatively stiff material, illustrated in FIG. 8. As shown, drapery 56 comprises outer layers 67 and 68 of the fabric. Sandwiched between layers 67 and 68 is a third layer 69 of an appropriately resilient and stiff material such as a plastic sheet which when supported by carrier 20*b* will maintain the outward flare established by the tapering outer edge of the carrier.

It will be seen that the carrier of the invention provides a number of advantages over carriers heretofore known. A pair of carriers, each of which has the same construction, can be used to create an overlapping of adjacent drapery panels without the necessity for an extension projecting from either of the carriers, which constitutes a source of difficulty in the operation of carriers of baton-traversing type. The drapery can be readily installed and removed from the carriers, and in addition, the height of the draperies above the floor can readily be adjusted in a convenient manner. Finally, the baton is readily visible on the front face of the draperies thus facilitating operation of the draperies while eliminating the need to use excess force to position them as desired.

The foregoing detailed description has been given for clearness of understanding only, and no unnecessary limitations should be understood therefrom, as modifications will be obvious to those skilled in the art.

I claim:

1. A master carrier assembly for a baton traverse drapery support system, said assembly comprising a hanger element adapted to be suspended from and slidable along a traverse rod;

a platform integrally connected to the lower end of said hanger element, said platform having an outer rim which is inclined relative to the direction of travel of said carrier along said carrier, a plurality of longitudinally spaced openings in said rim adapted to receive a drapery hook, a hook assembly having a hook adapted to engage one of said openings, said hook assembly having clamp means adapted to engage said rim, a vertical plate secured to said hook assembly, said plate being adapted to be attached to a drapery, and an elongated baton assembly having one end rotatably attached to said plate.

2. A carrier in accordance with claim 1 wherein said hanger element is horizontally elongated and is adapted to be positioned between the upper and lower edges of a C-shaped traverse rod.

3. A carrier in accordance with claim 2 wherein said hanger element is provided with a plurality of spacer elements positioned on both sides of each of said upper and lower edges.

4. A carrier in accordance with claim 2 wherein said hanger element and said platform have substantially the same length.

5. A carrier in accordance with claim 1 wherein said hook assembly is vertically elongated and said vertical plate is adapted to be removably secured to said hook assembly at a selected location along its height, said baton assembly being secured to the outer upper face of said drapery by means which penetrates the drapery and is secured to said plate.

* * * * *